US005279075A

United States Patent [19]

Sage et al.

[11] Patent Number: 5,279,075

[45] Date of Patent: Jan. 18, 1994

[54] ABRASIVE FLUID JET MACHINING

[75] Inventors: Colin Sage; Robert Semple, both of Bristol, England

[73] Assignee: Rolls-Royce plc, London, England

[21] Appl. No.: 21,330

[22] Filed: Feb. 23, 1993

[30] Foreign Application Priority Data

Feb. 29, 1992 [GB] United Kingdom ..... 9204392

[51] Int. Cl.[5] ..... B24C 1/08

[52] U.S. Cl. ..... 51/165.71; 51/410; 51/319

[58] Field of Search ..... 51/165R, 165.71, 410, 421, 427, 317-321, 326

[56] References Cited

U.S. PATENT DOCUMENTS

| | | | |
|---|---|---|---|
| 1,887,395 | 11/1932 | Billings | 51/421 |
| 3,270,464 | 9/1966 | Bowling, Jr. | 51/421 |
| 4,893,440 | 1/1990 | Gallant et al. . | |

FOREIGN PATENT DOCUMENTS

| | | | |
|---|---|---|---|
| 0169738 | 1/1986 | European Pat. Off. . | |
| 0123671 | 5/1988 | Japan | 51/410 |
| 0191572 | 8/1988 | Japan | 51/410 |
| 1206049 | 9/1970 | United Kingdom . | |
| 1460645 | 1/1977 | United Kingdom . | |
| 1498646 | 1/1978 | United Kingdom . | |
| 2249045 | 10/1991 | United Kingdom | 51/410 |

*Primary Examiner*—Jack Lavinder
*Attorney, Agent, or Firm*—Oliff & Berridge

[57] ABSTRACT

There is disclosed a method of machining using a jet 14 of abrasive laden fluid. A workpiece 10 is rotated about its central axis 11 on a table and the jet 14 is moved in a radial direction 16. By controlling the relative movements, an overlapping cut can be produced thereby machining an entire chosen area.

11 Claims, 3 Drawing Sheets

ABRASIVE FLUID JET MACHINING

The present invention relates to abrasive fluid jet machining.

According to the present invention there is provided a method of machining comprising the steps of directing towards a workpiece a jet of fluid containing abrasive material and generating relative movement between the workpiece and the jet.

In one arrangement the workpiece is moved relative to a support structure and preferably the workpiece is driven in rotation about an axis.

It is a preferred feature that, in addition, the jet is moved relative to said support structure. Preferably the jet is emitted from a nozzle which is movable in a generally flat plane which includes said axis of rotation of the workpiece.

It is a further preferred feature that the nozzle remains a predetermined distance from the workpiece during machining and also that the angle of the jet relative to the surface of the workpiece remains at a predetermined value. Conveniently the angle of the jet is such that relative to the radial tangent at the point of impact of the jet, which tangent passes through the axis, the angle of the jet has no component in the direction of said tangent.

Preferably the machining velocity of the workpiece relative to the jet remains constant irrespective of the distance of the jet from the axis.

With a preferred machining method the steps are repeated a number of times each with the movement of the nozzle in a different plane at a different location about the axis of rotation of the workpiece.

Conveniently the different locations are at equal angular spacings around the axis. In one method the planes are at 90 degree intervals.

Water is an example of a suitable fluid and aluminium oxide is an example of a suitable abrasive material.

In one preferred method the water is pumped through an orifice in a nozzle assembly to cause in an internal chamber a vacuum, the aluminium oxide is introduced to the water at a controlled mass flowrate and the mixture is ejected as a jet through the nozzle.

Preferably the method is carried out using a 7- axis robot which is computer controlled. Conveniently the method involves programming the shape of the workpiece and the jet characteristics into the computer and programming the desired machining process into the computer before the machining process is initiated.

Embodiments of the invention will now be described in more detail. The description makes reference to the accompanying diagrammatic drawings in which.

Figure 1:
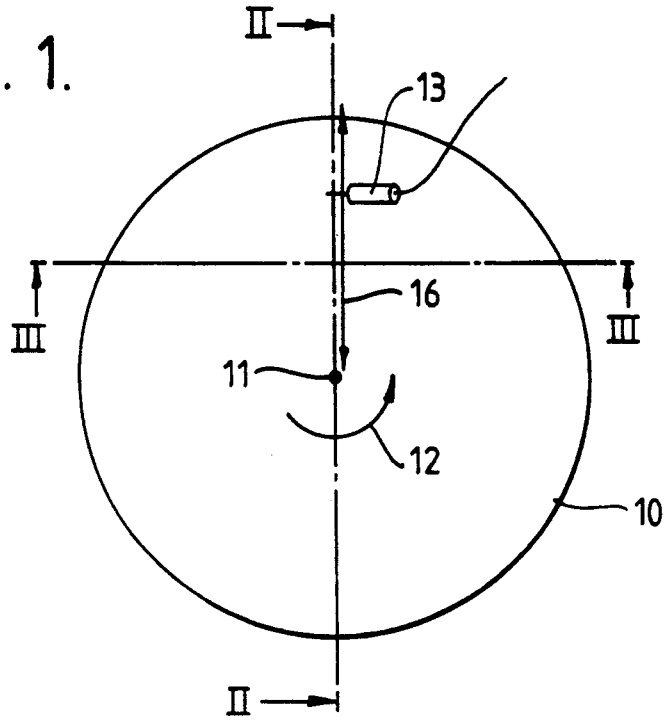
FIG. 1 shows in plan view a basic method according to the present invention.
Figure 2:
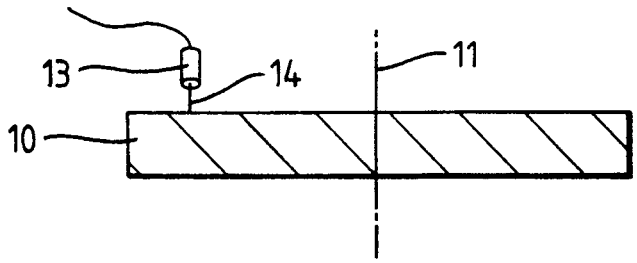
FIG. 2 is a sectional view on line II—II of FIG. 1.
Figure 3:
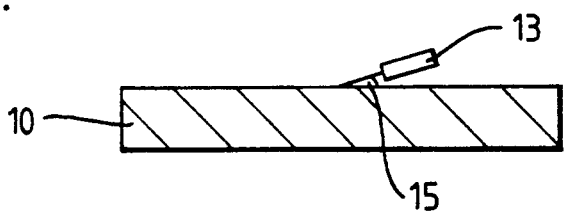
FIG. 3 is a sectional view on line III—III of FIG. 1.

FIGS. 1 to 3 show various views of one method of machining using an abrasive fluid jet. A workpiece 10 is rotated about a central axis 11 as indicated by arrow 12. Preferably the workpiece is submerged in a water bath although this is not shown in the drawings.

A nozzle assembly 13 is provided and is connected to movement control means which are not shown in FIGS. 1 to 3 for the sake of simplicity. The nozzle assembly is also connected to controlled supplies of water and aluminium oxide abrasive. In one arrangement, a pump delivers water under pressure through an orifice. The resulting high velocity stream of water results in a vacuum being created in an internal chamber in the nozzle assembly, into which the aluminium oxide powder is added at a controlled mass flow rate using a screw operated delivery system. The mixing of the water and abrasive is continued in a cutting nozzle from which a jet 14 of abrasive laden water is emitted.

The jet 14 of water is directed at the surface of the workpiece 10 and removes material from the workpiece 10 by particle erosion. The nozzle assembly 13 is held so that the jet 14 hits the workpiece 10 at a predetermined, preferably optimum angle 15.

While the workpiece 10 is rotated about the axis 11, the nozzle assembly 13, and therefore the abrasive jet 14, is tracked in a radial path 16 between the axis 11 and the outer periphery of the workpiece 10. In this way, the machining process creates an overlapping spiralled cut, analogous to a record groove with abutting cuts. With this cutting technique an entire chosen area can be machined. Alternatively, the nozzle assembly 13 could move incrementally along the path, the size and timing of the increments being such that overlapping circular cuts are made. Again an entire chosen area can be machined.

It has been found that these machining method are particularly, but not exclusively, suitable for the removal of the external surface layers of turbine or compressor discs. The removal of 0.001 to 0.005 inches of material may possibly improve the fatigue performances of such discs in some circumstances. Many other applications both simple and complex are of course possible and will not be listed.

Figure 4:
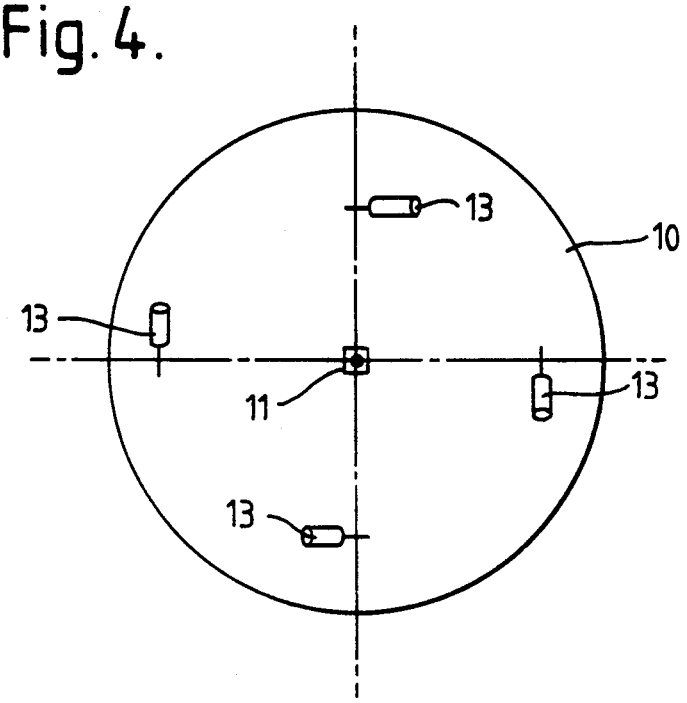
FIG. 4 is an illustrative plan view of a preferred method of operation.

In FIG. 4 the nozzle assembly 13 is shown in four positions relative to the workpiece 10 spaced at 90 degree intervals about the axis 11. The machining process is preferably conducted with the nozzle assembly 13 in each of these four positions, in each position the nozzle assembly 13 being movable along paths corresponding to radial path 16. These overlayed passes result in a particularly good surface finish. Of course any chosen number of overlayed passes could be made at whatever desired angular intervals about the axis 11. In practice it is preferred that the nozzle assembly remains in one position and the workpiece is indexed through 90°.

The movements of the nozzle assembly 13 and the workpiece 10 are controlled so that a number of preferred requirements are met. Although not essential, these requirements ensure efficiency and a good quality finish. Firstly, the nozzle assembly remains at a chosen distance from the workpiece 10. Secondly, the angle of the jet relative to the surface of the workpiece 10 remains constant. Thirdly, the machining velocity of the surface of the workpiece relative to the abrasive jet 14 remains constant. Preferably, on curved surfaces, the jet 14 does not have a directional component in the direction of the tangent at the point of contact of the jet, which tangent also passes through the axis 11.

Figure 5:
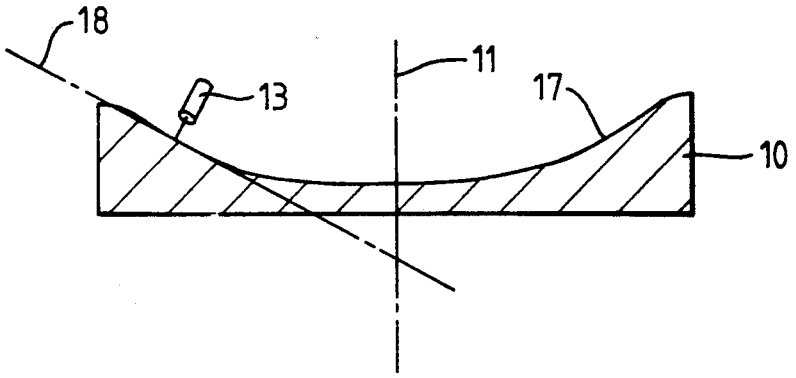
FIG. 5 is a sectional view similar to FIG. 2 only with a different shaped workpiece.

This last point is illustrated in FIG. 5 which shows a workpiece 10 having a concave surface 17. The tangent passing through the axis 11 of rotation and the point of contact of the jet is shown by reference numeral 18. The jet does not have a directional component in the direction of this tangent.

When non-planar surfaces are being machined it will be appreciated that the path of the nozzle assembly 13 will not be exactly radial but will be curved. However it preferably remains in a radial plane which includes the axis 11 of rotation of the workpiece.

It will be appreciated that using the above described methods and suitable control techniques, all manner of shapes can be machined and it will be clear to the skilled reader how to conduct such machining processes.

Figure 6:
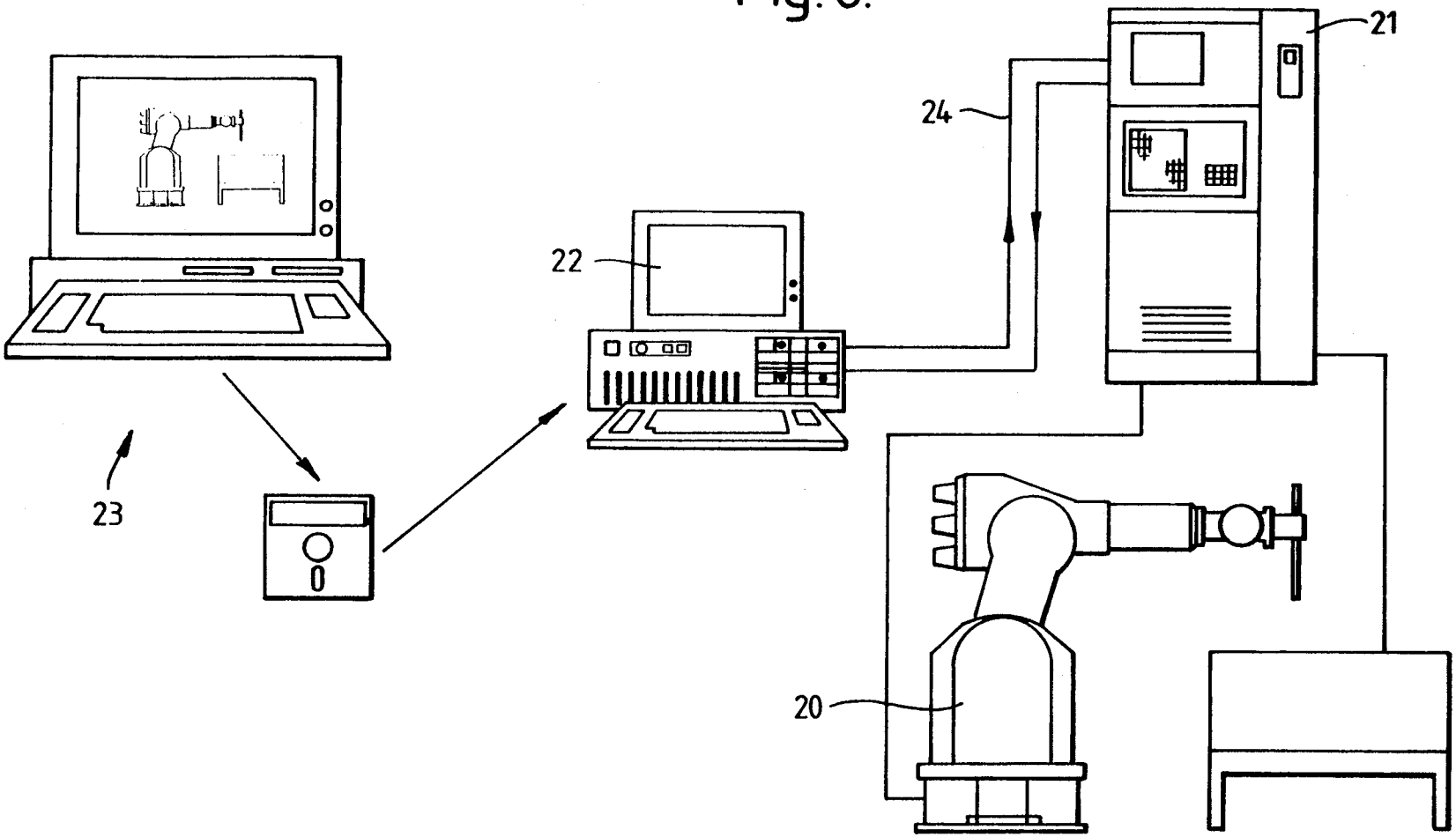
FIG. 6 is a schematic picture of a computer controlled method according to the present invention.

In one particular, but not exclusive, machining system as shown in FIG. 6 the rotation of the workpiece and the translation of the nozzle assembly is effected using a 7- axis robot 20. One axis drives a submerged rotary table upon which the workpiece is mounted and the other axes control the movement of the nozzle assembly 13. The first orifice of the nozzle assembly is of the synthetic ruby type and the cutting nozzle is made of solid tungsten carbide.

The robot 20 is controlled by signals from a robot controller 21, which signals are in turn are generated as a result of data from a computer 22. The data in the computer 22 is produced off-line at 23 using a graphical simulation package which incorporates a kinematic modeller. Firstly the details and features of the abrasive jet are inputted into a model of the 7 axis Robot Configuration, then the information, such as component sections, for the workpiece are inputted. The detail of the sections is of course important so that the jet can follow the curves of the workpiece as accurately as possible.

Once the information has been inputted a program is generated then post processed into a language understood by the robot controller 21 and transferred into the controller 21 via DNC link 24.

Other control systems are of course suitable for controlling the workpiece 10 and nozzle assembly 13 in the above machining methods.

Also it will be appreciated that the workpiece could be moved in other fashions other than simple rotation. If elliptical in shape for example the workpiece could be moved accordingly. If desired it may be possible for both the workpiece and the nozzle assembly to be moved in straight lines. Also it is envisaged that the nozzle assembly need not be restricted to movement in radial planes.

We claim:

1. A method of machining a surface of a workpiece comprising the steps of (a) directing towards the surface a jet of fluid containing abrasive material, and (b) generating relative movement between the workpiece and the jet, the workpiece being driven in rotation about an axis; the jet being emitted from a nozzle which is moved in a plane in which is embedded the axis of rotation of the workpiece; the nozzle remaining a predetermined distance from the workpiece and the angle of the jet relative to said surface remaining at a predetermined value during machining;

wherein the method further comprises repeating steps (a) and (b) in each of a plurality of different planes spaced angularly about and extending through said axis.

2. A method as claimed in claim 1 wherein, when said surface is curved, the angle of the jet is such that relative to a tangent to the surface at the point of impact of the jet, which tangent passes through said axis, the angle of the jet has zero component in the direction of said tangent.

3. A method as claimed in claim 1 wherein the machining velocity of a workpiece relative to the jet remains constant irrespective of the distance of the jet from the axis.

4. A method as claimed in claim 1 wherein the different planes are at equal angular spacings around the axis.

5. A method as claimed in claim 1, wherein the planes are angularly spaced at 90° intervals.

6. A method as claimed in claim 1 wherein the fluid is water.

7. A method as claimed in claim 1 wherein the abrasive material is aluminium oxide.

8. A method as claimed in claim 7 wherein the water is pumped through an orifice in a nozzle assembly to cause in an internal chamber a vacuum, the aluminium oxide is introduced to the water at a controlled mass flowrate and the mixture is ejected as a jet through the nozzle.

9. A method as claimed in claim 1 using a 7- axis, computer controlled robot to move the workpiece and the nozzle.

10. A method as claimed in claim 9 further comprising the steps of programming the shape of the workpiece and the jet characteristics into the computer and programming the desired machining process into the computer before the machining process is initiated.

11. A method as claimed in claim 1, wherein steps (a) and (b) are repeated a number of times, the movement of the jet takes place each time in a different one of said pluralities of planes.

* * * * *